US009555468B2

(12) United States Patent
Megolago Albani

(10) Patent No.: US 9,555,468 B2
(45) Date of Patent: Jan. 31, 2017

(54) PROCESS AND PLANT FOR PRODUCING COMPONENTS MADE OF AN ALUMINIUM ALLOY FOR VEHICLES AND WHITE GOODS, AND COMPONENTS OBTAINED THEREBY

(76) Inventor: Lucio Megolago Albani, Bergamo (IT)

( * ) Notice: Subject to any disclaimer, the term of this patent is extended or adjusted under 35 U.S.C. 154(b) by 0 days.

(21) Appl. No.: 14/424,696

(22) PCT Filed: Sep. 12, 2012

(86) PCT No.: PCT/IT2012/000278

§ 371 (c)(1),
(2), (4) Date: Feb. 27, 2015

(87) PCT Pub. No.: WO2014/041569

PCT Pub. Date: Mar. 20, 2014

(65) Prior Publication Data

US 2015/0258606 A1 Sep. 17, 2015

(51) Int. Cl.
*B22D 47/00* (2006.01)
*B22D 17/00* (2006.01)
(Continued)

(52) U.S. Cl.
CPC ..... *B22D 17/007* (2013.01); *B21C 23/21* (2013.01); *B21C 23/32* (2013.01); *B21C 29/003* (2013.01);
(Continued)

(58) Field of Classification Search
CPC ..... B22D 17/007; B22D 21/007; C22F 1/04; B21C 23/002; B21C 23/02; B21C 23/21; B21C 23/32; B21C 29/003
See application file for complete search history.

(56) References Cited

U.S. PATENT DOCUMENTS 4,569,218 A * 2/1986 Baker ..... B21J 5/00 164/900
4,638,535 A * 1/1987 Pryor ..... C22C 1/005 86/19.5
(Continued)

FOREIGN PATENT DOCUMENTS

WO WO2007004241 A1 1/2007
WO 2010/005306 A1 * 1/2010 ..... B21C 23/00

*Primary Examiner* — Edward Tolan
(74) *Attorney, Agent, or Firm* — Burns & Levinson LLP; John C. Serio

(57) ABSTRACT

A plant and a process are disclosed for producing components made of an aluminum alloy for vehicles and white goods, through the steps of: providing thixotropic billets made of an aluminum alloy; sizing the billets depending on a ratio between weight and size of the component to be produced, thereby obtaining crop ends of material; heating the crop ends in a range of temperatures during which both a solid phase and a liquid phase coexist with a prevalence in the solid phase (more than 50%) in heating means (5); loading, through loading means (9), the crop ends in an injecting vessel made of non-magnetic steel for further workings; removing, through scalping devices, an external part of the crop ends that has become cooled when passing from the heating means (5) to the loading means (9); firstly injecting the crop ends through a press; secondly injecting the crop ends through the press in 18 milliseconds by using a closed-loop control system and increasing the injection unit power with respect to a closing unit of the press; thirdly injecting the crop ends by coining the finished part in order to remove all porosities; extracting the molding through extracting means (13); depositing the molding onto a conveyor belt (15); and controlling a quality of the obtained molding, the molding being then sent to downstream mechanical workings and/or an heat treatment.

15 Claims, 1 Drawing Sheet

(51) Int. Cl.

| | |
|---|---|
| ***B22D 17/20*** | (2006.01) |
| ***B21C 23/21*** | (2006.01) |
| ***B21C 23/32*** | (2006.01) |
| ***B21C 29/00*** | (2006.01) |
| ***B22D 17/22*** | (2006.01) |
| ***B22D 21/00*** | (2006.01) |
| ***C22F 1/04*** | (2006.01) |

(52) U.S. Cl.
CPC ..... *B22D 17/2007* (2013.01); *B22D 17/2076* (2013.01); *B22D 17/2209* (2013.01); *B22D 17/2236* (2013.01); *B22D 21/007* (2013.01); *B22D 47/00* (2013.01); *C22F 1/04* (2013.01)

(56) References Cited

U.S. PATENT DOCUMENTS 4,709,746 A * 12/1987 Young ..... B22D 11/045 164/443
4,771,818 A * 9/1988 Kenney ..... B22D 18/02 164/113
5,575,325 A * 11/1996 Sugiura ..... B21J 5/004 164/120
5,630,466 A * 5/1997 Garat ..... B22D 17/007 164/113
5,730,201 A * 3/1998 Rollin ..... B22D 17/10 164/113
5,865,238 A * 2/1999 Carden ..... B22D 17/007 164/113
5,879,478 A * 3/1999 Loue ..... C22C 21/04 148/437
5,968,292 A * 10/1999 Bergsma ..... C22F 1/043 148/437
6,311,759 B1 * 11/2001 Tausig ..... B21J 5/004 164/113
6,554,057 B1 * 4/2003 Arnold ..... B21J 5/004 164/113
8,978,735 B2 * 3/2015 Zheng ..... B22D 43/00 164/312
2005/0022384 A1 2/2005 Niedermann et al.

* cited by examiner

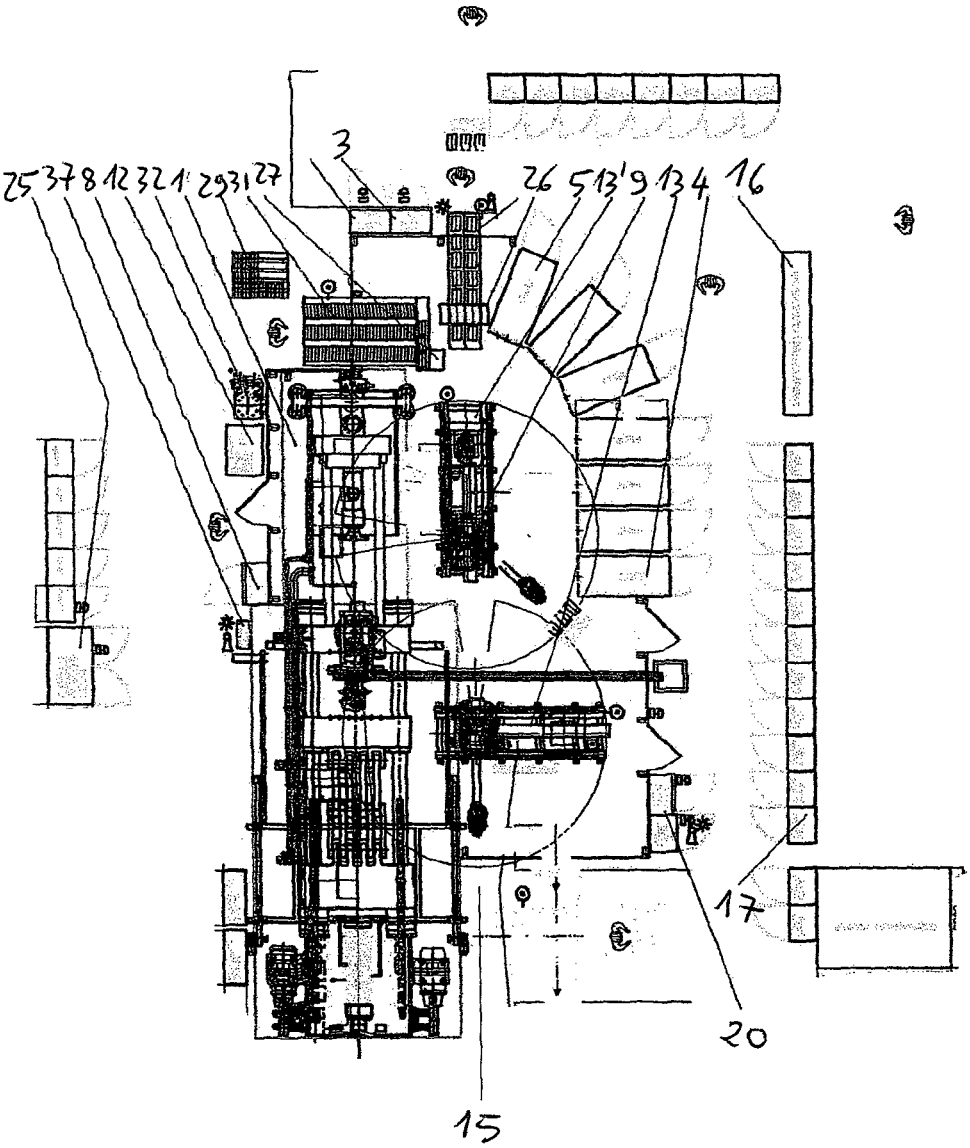
25
37
8
12
32
1
29
31
27
3
26
5
13
9
13
4
16
17
20
15

PROCESS AND PLANT FOR PRODUCING COMPONENTS MADE OF AN ALUMINIUM ALLOY FOR VEHICLES AND WHITE GOODS, AND COMPONENTS OBTAINED THEREBY

CROSS-REFERENCE TO RELATED APPLICATIONS

This is a U.S. national phase application under 35 U.S.C. 371 of International Application No. PCT/IT2012/000278, entitled PROCESS AND PLANT FOR PRODUCING COMPONENTS MADE OF AN ALUMINIUM ALLOY FOR VEHICLES AND WHITE GOODS, AND COMPONENTS OBTAINED THEREBY, filed on Sep. 12, 2012.

BACKGROUND OF THE INVENTION

1) Field of the Invention

The present invention refers to a process and a plant for producing components made of an aluminium alloy for vehicles and white goods, and to the components obtained through the above-stated process and plant.

2) Background Art

In the field of parts made of an aluminium alloy for vehicles, a process and a plant of this type have been disclosed in WO-A-02081125 and WO-A-2007004241, of which the present invention is an improvement. In fact, the process and plant disclosed in WO-A-02081125 and WO-A-2007004241 are useful only for preparing small-sized parts for vehicles and, using a cast of thixotropic aluminium, do not obtain completely satisfactory parts. Moreover, these processes use a liquid detaching agent, whose disposal has negative impacts at environmental level.

SUMMARY OF THE INVENTION

Object of the present invention is solving the above prior-art problems, by providing components made of an aluminium alloy for vehicles and white goods whose weight is very low and whose cost is much lower than the current one and that keep, and preferably highly improve, the quality characteristics of current products.

A further object of the present invention is providing a process and a plant that are adapted to realise components as mentioned above and that are such that the end product needs only reduced workings: this allows simplifying the production processes and highly reducing their costs, obviously at a benefit for the end product.

The above and other objects and advantages of the invention, as will appear from the following description, are obtained by a process, a plant and an end product as those claimed in the respective independent claims. Preferred embodiments and non-trivial variations of the present invention are claimed in the dependent Claims.

BRIEF DESCRIPTION OF THE DRAWINGS

The present invention will be better described by some preferred embodiments thereof, given as a non-limiting example, with reference to the enclosed drawings, in which the only FIG. 1 is a schematic diagram of the plant adapted to realise the process of the present invention to produce the inventive components.

DETAILED DESCRIPTION OF PREFERRED EMBODIMENTS

The process and the plant of the invention will be disclosed herein below in their embodiment that is adapted to produce components for motor vehicles as listed below. It is obvious that the process and the plant could be used, practically without modifications apart from the dimensional ones, for producing components similar to those listed below.

The components that have been discovered as able to be produced through the plant, the process and the material of the present invention are as follows:

- vehicle body elements, such as internal bodywork, door panels, instrument-holding dashboard, framework for seats, framework for steering wheels and other internal vehicle parts;
- internal door panels integrated with door drive moving functions;
- structural and aesthetic elements of car body and/or motorbyke chassis, engine blocks and motorbyke components;
- components for cars and motorbykes such as front and rear car suspensions, engine supporting frame and other component parts;
- vehicle engines;
- aeronautical elements, such as wheels, seats and panels for aeroplanes;
- railway elements, such as seats and panels for trains;
- components of machines in the white goods sector, such as washing machines, dish washing machines, small white goods and the like.

With respect to the process disclosed in WO-A-02081125 and WO-A-2007004241, the new process is not a cast of thixotropic aluminium any more, but instead an injection molding whose characteristics and peculiarities approach the process more to a plastic molding and to an extrusion than to die-casting.

FIG. 1 is a schematic view of the plant for producing components for vehicles of the invention; first of all, such plant comprises means 5 for heating the crop ends formed of thixotropic billets made of an aluminium alloy (as can be better seen below), in which such billets are sized depending on the ratio between weight and size of the component to be realised. The means 5 are fed by a loader 4 and heat the crop ends in a range of temperatures during which both solid phase and liquid phase coexist with a prevalence in the solid phase (more than 50%), and are composed of heating fumaces 5, that in particular are electromagnetic induction furnaces 5 comprising modular stations that are able to be composed. The induction heating fumace guarantees, in addition to keeping the temperature within very restricted tolerances, an energy induction into the billets, which guarantees that a perfect metallographic structure re-forms at an intermediate physical state between the solid state and the liquid state. Therefore, the temperature of the piece is detected by measuring the active power of the induced energy in the material in a predetermined period of time. The inventive plant further comprises means 9 for loading the heated crop ends in an injecting vessel made of non-magnetic steel for further workings, that must have specific characteristics for products of the "Semi Solid Material" (S.S.M.) type; the loading means 9 are composed of a first handling robot, that is an anthropomorphic robot equipped with a mechanical gripping hand adapted to handle the vessel in which the billets are placed in order to be heated and transported.

The plant then comprises means (not shown) for removing by scalping an external part of the crop ends that has become cooled when passing from the heating means 5 to the loading means 9.

The plant then comprises means 11 for forming a molding, which operate with three injection steps that are specific of the inventive process: namely, the means 11 perform a first injection of the scalped crop ends through a press (not shown), a second injection of the scalped crop ends in 18 milliseconds by using a closed-loop control system and by increasing the injection unit power with respect to a closing unit of the press, and a third injection of the crop ends by coining the finished part in order to remove all porosities.

In particular, such means 11 for forming are composed of a die-casting machine, that is equipped with a die 8 adapted to produce components in S.S.M. The die 8 is lubricated by lubricating means 12 before every injection of metal through a detaching agent, that is solid and not liquid, and therefore has no environmental impact and does not require its disposal, like the traditional detaching agents. Preferably, the die-casting machine 11 is equipped with an injection unit controlled by a closed-loop system, that allows a real-time control of the three injection steps. With the above-mentioned arrangements, the press with which the die-casting machine 11 is equipped has a very powerful injection system that is able to manage the injection step with a high dynamicity, and a maximum increasing speed of the injection force according to the construction specifications. This is made possible by controlling the injection process through a closed-loop system that allows a real-time control. A high dynamicity is then realised not only as regards the speed, but also for acceleration, braking and repeatability and programmability of the process. The closed loop allows a programmability on at least ten injection variables with 0.1 m/s resolutions. The suitably-adjusted press injects the billet inside the recesses of the die 8.

Further preferably, the lubricating means 12 are composed of a lubricating robot equipped with a lubricating head adapted to spray water, air and a detaching agent onto the die 8; such operation can also be performed through a manual nozzle.

Returning to FIG. 1, the plant of the invention further comprises means 13 for extracting the molding, and means for depositing the molding from the extracting means 13 onto a conveyor belt 15, that are preferably composed of a second handling robot or of extracting means 13 of a manual type.

In a variation of the inventive plant, the means for depositing the molding are replaced by means 16 for previously cooling the molding, and means for depositing the cooled molding onto a shearing die installed on a shearing press 17 for shearing feedheads and/or risers, that are unloaded through unloading means 20.

In particular, the means 16 for previously cooling can be composed of a tank 16 containing heated and heat-adjusted water. In FIG. 1 a station 26 is further provided for cleaning the vessel prepared when going out of the furnace 5.

Finally, the inventive plant comprises means for controlling the quality of the obtained molding, before sending the molding to downstream mechanical workings and/or an heat treatment. Such means for controlling the quality of the obtained molding are composed of a device 27 for detecting the presence of the molding, a control pulpit 29, control panels 31 for the billet heater, process control panels 33, a control panel 35 of the extractor 13 and a control panel 37 of the conveyor 15 for the finished pieces.

In the above-described plant, the die 8 installed on the press for producing components can be equipped with one or more carriages for defining possible channels of the components and is equipped with air vents. The die 8 can be further equipped with shearing or tearing plates in order to remove the feedhead from the molding, and with internal heat-adjusting channels.

In order to use such a die 8, the plant can be further equipped with units 25 for heat-adjusting the die 8 itself, that are composed of a modular system equipped with resistances or gas boilers for heating water or diathermal oil, and with pipings for flowing such water or oil from a pump of the unit inside the heat-adjusting channels of the die 8.

The above press can be of the hydraulic and/or electromechanical type, in a toggle-press version or in a non-toggle-press version with two planes.

Moreover, the above press can perform firstly an extrusion step and then an injection step, with the chance of having two or more injection points with two or more injectors.

The above-described plant is adapted to realise the process for producing components for vehicles and white goods of the invention, which process comprises the steps of:

- providing thixotropic billets made of an aluminium alloy;
- sizing the billets depending on a ratio between weight and size of the component to be produced, thereby obtaining crop ends of material;
- heating the crop ends in a range of temperatures during which both a solid phase and a liquid phase coexist with a prevalence in the solid phase (more than 50%) in heating means 5;
- loading, through the loading means 9, the heated crop ends in an injecting vessel made of non-magnetic steel for further workings with machines with specific characteristics for products of the Semi Solid Material, SSM, type;
- removing, through scalping devices, an external part of the crop ends that has become cooled when passing from the heating means 5 to the loading means 9; this step is similar to an extrusion, since the scalping device, that can be found in the injection vessel, is commonly used in extrusors: the scalped part is the only one that gets oxidised when heating, and this then guarantees that there are no oxides in the molded piece;
- firstly injecting the scalped crop ends through a press;
- secondly injecting the crop ends through the press in 18 milliseconds by using a closed-loop control system and increasing the injection unit power with respect to a closing unit of the press; the 18-millisecond period guarantees that there are no so-called "cold spots", namely areas where the material has arrived too cold to be joined: in order to realise so short injection times, the injecting system of the press is very different from the one of a traditional die-casting press, not only for the presence of the closed-loop control system, but also for the higher power of the injection unit (about 30%) with respect to the press closing unit;
- thirdly injecting the crop ends by coining the finished part in order to remove all porosities: in order to obtain this, the crop ends are kept for about 10 seconds under a pressure of 46 t/cm$^2$;
- extracting the molding through extracting means 13;
- depositing the molding from the extracting means 13 onto a conveyor belt 15; and
- controlling a quality of the obtained molding, the molding being then sent to downstream mechanical workings and/or an heat treatment.

In order to allow an optimum use of the above-stated process and plant, it is also necessary to provide a suitable material, that allows producing components in an aluminium alloy for vehicles and white goods of the invention and is composed of an aluminium alloy having the following characteristics:

centesimal chemical composition; and finely-divided, metallographic structure of the globular type, that is a thixotropic structure. The globular microstructure provides the billet with a high fluidodynamic property even with high fractions of matter at a solid state. This allows performing the die-casting process at temperatures that are near the solidification one.

The main characteristic of the aluminium alloys that are die-cast with the thixotropic system consists (when they are in a partial solidification phase) in the drastic reduction of the so-called "casting errors", that are the macro- and micro-cavities from shrinking or gas. The production cycle of a part produced with a thixotropic alloy can have different results according to the system being used for the mixing action and the degassing system used in the billet-production step. The thixotropic alloys used in the present invention, in addition to being aluminium alloys, can also be magnesium alloys. The thixotropic aluminium and/or magnesium alloy used in the present invention can be obtained both with electromagnetic stirring systems (not shown) and with chemical additives.

With the above-described process and system, and using the above material, it is possible to realise components made of an aluminium alloy whose characteristics are equal to or better than those of similar currently-marketed components. In particular, the advantages of the die-casting with the S.S.M. process when producing components for vehicles are as follows:

product with high metallurgic and mechanical performance characteristics;

innovative solutions that are able to improve the reliability under operating conditions;

high health of the part;

reduction of scraps;

reduction of mechanical workings;

exceptional mechanical characteristics with a possible heat treatment:

minimum traction strength: 300 mpa minimum ultimate tensile strength: 225 mpa minimum elongation: 12%

(all the above results being obtained with reference to an A 356.0 alloy).

It is further necessary to point out the positive results due to the S.S.M. process that cannot be directly measured on the product, but are connected thereto, such as for example lower working temperatures that have as a direct consequence energy savings, lower emissions of smokes and powders and consequently better environmental conditions.

With respect to the prior art, other improvements are related to the material of which the vessels used for SSM molding processes are now made of non-magnetic steel instead of ceramics. In fact, with ceramics vessels, it is impossible to produce big-sized or high-weight parts, since the ceramics vessels should then have such high thickness that the electromagnetic field would be compromised: this would induce heat in the billet and it would then be impossible to homogeneously heat the material.

The invention claimed is:

1. A process for producing components made of an aluminium alloy for vehicles and white goods, comprising the steps of:

providing thixotropic billets made of an aluminium alloy;

sizing the billets depending on a ratio between weight and size of the component to be produced, thereby obtaining crop ends of material;

heating the crop ends in a range of temperatures during which both a solid phase and a liquid phase coexist with a prevalence, namely more than 50%, in the solid phase using electromagnetic induction furnaces providing restricted tolerance and an energy induction into the billets producing a preferred metallographic structure;

loading, through loading means, the heated crop ends in an injecting vessel made of non-magnetic steel for further workings with machines with specific characteristics for products of the Semi Solid Material, SSM, type;

removing, through scalping devices, an external part of the crop ends that has become cooled when passing from the heating means to the loading means;

firstly injecting the scalped crop ends through a press;

secondly injecting the crop ends through the press in 18 milliseconds by using a closed-loop control system and increasing the injection unit power with respect to a closing unit of the press, said closed loop control system and increased injection power providing an injection time of said 18 milliseconds preventing cold spots within said molding;

thirdly injecting the crop ends by coining the finished part in order to remove all porosities;

extracting the molding through extracting means;

depositing the molding from the extracting means onto a conveyor belt; and controlling a quality of the obtained molding, the molding being then sent to downstream mechanical workings and/or an heat treatment.

2. The process of claim 1, wherein the step of thirdly injecting is performed by keeping the part for 10 seconds under a pressure of 46 t/cm$^2$.

3. Plant for producing components made of an aluminium alloy for vehicles and white goods, the plant comprising:

a. means for heating crop ends formed of thixotropic billets made of an aluminium alloy wherein said heating means is electromagnetic induction furnaces providing restricted tolerance and an energy induction into the billets producing a preferred metallographic structure, the billets being sized depending on a ratio between weight and size of the component, the heated crop ends having a range of temperatures during which both a solid phase and a liquid phase coexist with a prevalence, namely more than 50%, in the solid phase;

b. means for loading the heated crop ends in an injecting vessel made of non-magnetic steel for further workings with machines with specific characteristics for products of the Semi Solid Material, SSM, type, wherein the loading means are composed of a first handling robot, the first handling robot being an anthropomorphic robot equipped with a mechanical gripping hand adapted to handle the vessel in which the billets are placed in order to be heated and transported;

c. means for removing by scalping an external part of the crop ends that has become cooled when passing from the heating means to the loading means;

d. means for firstly injecting the scalped crop ends through a press;

e. means for secondly injecting the scalped crop ends in 18 milliseconds by using a closed-loop control system and increasing the injection unit power with respect to a closing unit of the press said closed loop control system and increased injection power providing an injection time of said 18 milliseconds preventing cold spots within said molding;

f. means for thirdly injecting the crop ends by coining the finished part in order to remove all porosities;

g. means for extracting the molding;

h. means for depositing the molding from the extracting means onto a conveyor belt; and i. means for controlling a quality of the obtained molding, the molding being then sent to downstream mechanical workings and/or an heat treatment.

4. The plant of claim 3, wherein the means for forming are composed of a die-casting machine, the die-casting machine being equipped with a die adapted to produce components in S.S.M., the die being lubricated by lubricating means before every injection of metal through a solid detaching agent.

5. The plant of claim 4, wherein the die-casting machine is equipped with an injection unit controlled by a closed-loop system, the closed-loop control system allowing a real-time control of the three injection steps.

6. The plant of claim 4, wherein the lubricating means are composed of a lubricating robot equipped with a lubricating head adapted to spray water, air and detaching agent onto the die, or through a manual nozzle.

7. The plant of claim 3, wherein the extracting means are composed of a second handling robot, or of manual extracting means.

8. The plant of claim 3, further comprising a means for cooling is composed of a tank containing heated and heat-adjusted water.

9. The plant of claim 3, wherein the die installed on the press for producing components is equipped with one or more carriages for defining a channel of the component and is equipped with air vents.

10. The plant of claim 9, wherein the die is further equipped with shearing or tearing plates in order to remove the feedhead from the molding.

11. The plant of claim 9, wherein the die is further equipped with internal heat-adjusting channels.

12. The plant of claim 3, wherein the plant is further equipped with units for heat-adjusting the die.

13. The plant of claim 12, wherein the heat-adjusting units are a modular system equipped with resistances or gas boilers for heating water or diathermal oil, and with pipings for flowing such water or oil from a pump of the unit inside the heat-adjusting channels of the die.

14. The plant of claim 3, wherein the press is of the hydraulic and/or electromechanical type, in a toggle-press version or in a non-toggle-press version with two planes.

15. The plant of claim 3, wherein the press is adapted to perform firstly an extrusion step and then an injection step, the press being equipped with two or more injection points with two or more respective injectors.

* * * * *